US006722346B2

(12) United States Patent
Mühlhausen

(10) Patent No.: US 6,722,346 B2
(45) Date of Patent: Apr. 20, 2004

(54) CONNECTION

(75) Inventor: Ralf Mühlhausen, Rotenburg (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 10/045,253

(22) Filed: Jan. 14, 2002

(65) Prior Publication Data

US 2002/0096147 A1 Jul. 25, 2002

Related U.S. Application Data

(63) Continuation of application No. PCT/EP01/03472, filed on Mar. 27, 2001.

(30) Foreign Application Priority Data

May 13, 2000 (DE) ..... 100 23 529

(51) Int. Cl.[7] ..... F02M 55/02
(52) U.S. Cl. ..... 123/469; 123/509; 123/514
(58) Field of Search ..... 123/509, 516, 123/514, 468, 469, 470, 506; 285/256, 330, 259; 137/571

(56) References Cited

U.S. PATENT DOCUMENTS

| | | | | | |
|---|---|---|---|---|---|
| 4,795,320 | A | * | 1/1989 | Tuckey | 417/360 |
| 4,817,997 | A | * | 4/1989 | Ingram | 285/256 |
| 5,613,476 | A | * | 3/1997 | Oi et al. | 123/509 |
| 5,623,910 | A | * | 4/1997 | Riggle | 123/510 |
| 5,715,798 | A | * | 2/1998 | Bacon et al. | 123/514 |

FOREIGN PATENT DOCUMENTS

| | | |
|---|---|---|
| DE | 43 02 382 C2 | 9/1993 |
| DE | 44 00 213 C2 | 8/1994 |
| DE | 295 19 920 U1 | 4/1997 |
| DE | 198 39 130 A1 | 5/1999 |

* cited by examiner

*Primary Examiner*—Carl S. Miller
(74) *Attorney, Agent, or Firm*—Laurence A. Greenberg; Werner H. Stemer; Gregory L. Mayback

(57) ABSTRACT

A connection for a feed line at a feed pump pumping fuel out of a fuel tank, includes a nonreturn valve disposed in a horizontal portion of a connection stub. The connection stub is held on the feed pump by a latching device. The connection permits a particularly compact configuration of the feed pump.

8 Claims, 1 Drawing Sheet

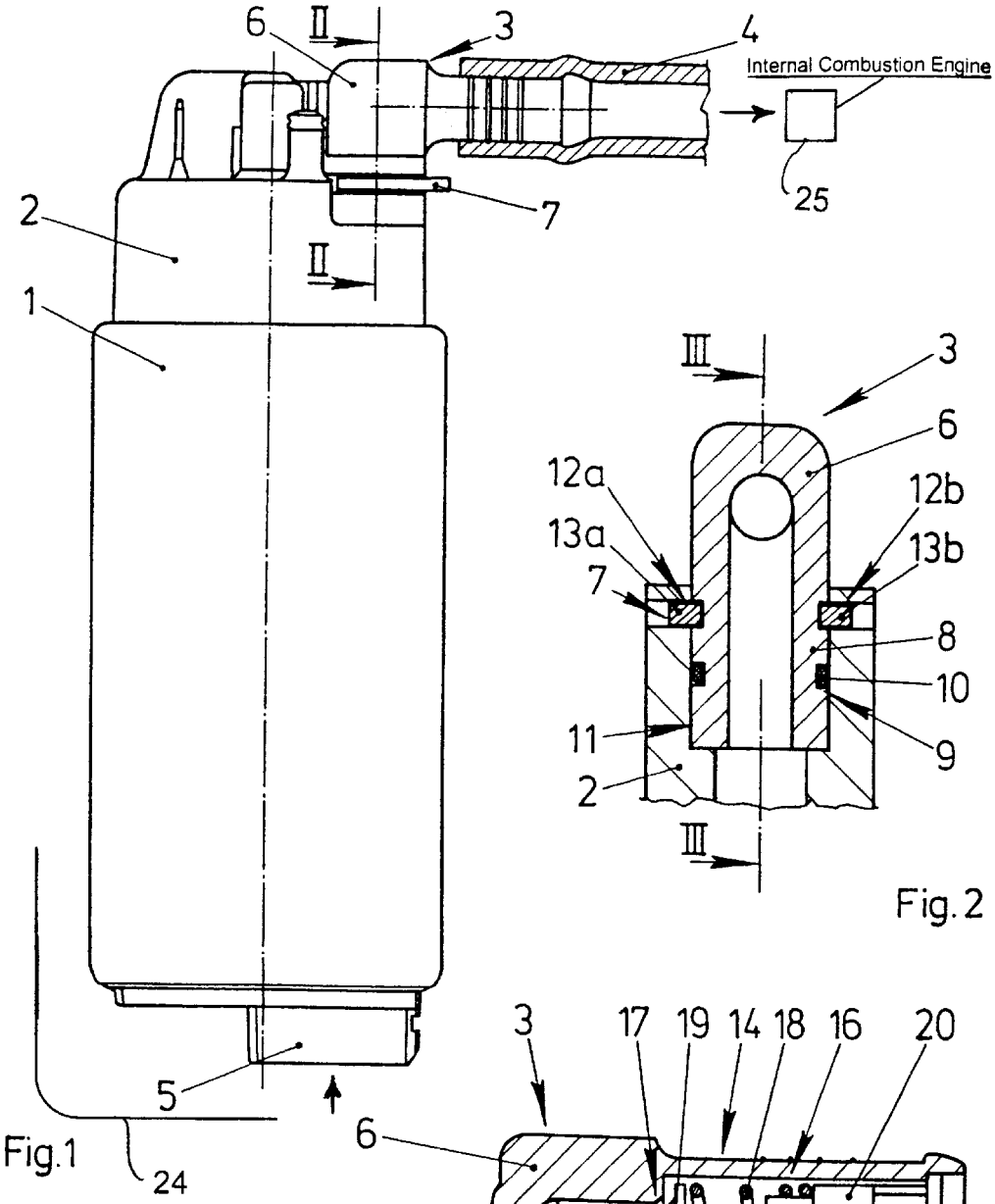
Fig.1
Fig.2
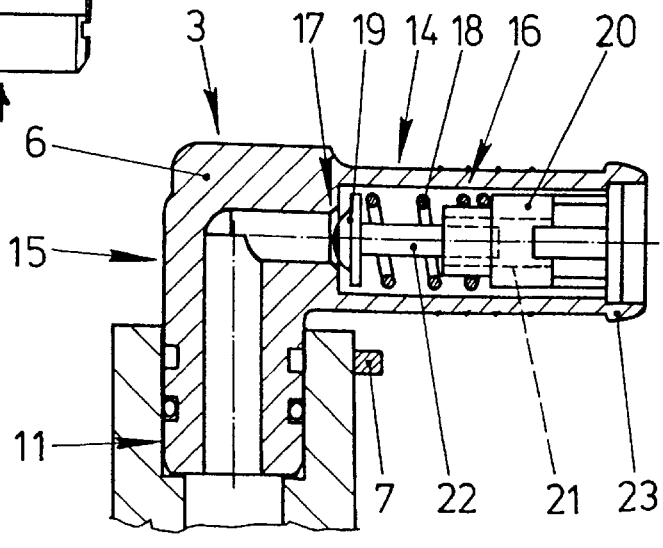
Fig.3

CONNECTION

CROSS-REFERENCE TO RELATED APPLICATION

This application is a continuation of copending International Application No. PCT/EP01/03472, filed Mar. 27, 2001, which designated the United States.

BACKGROUND OF THE INVENTION

Field of the Invention

The invention relates to a connection for a feed line which leads to an internal combustion engine of a motor vehicle. The connection is disposed at a feed pump that pumps fuel out of a fuel tank. The connection has a connection stub with a horizontal portion. The horizontal portion projects away from the feed pump for connection of the feed line. A nonreturn valve is disposed in the connection stub.

Such connections are often used in today's motor vehicles and are known in practice. In the case of the known connection, the nonreturn valve is mounted in a fixed manner in a housing cover of the feed pump. The connection stub has an angle with a vertical portion for form-locking connection to the housing cover. A form-locking connection is one which connects two elements together due to the shape of the elements themselves, as opposed to a force-locking connection, which locks the elements together by force external to the elements. The connection stub can be connected to the feed pump in various angular positions by virtue of that angle. The disadvantage of the known connection is that it has very large dimensions in the vertical direction. However, today's fuel tanks have only very limited dimensions, often making it impossible to mount feed pumps with large dimensions.

SUMMARY OF THE INVENTION

It is accordingly an object of the invention to provide a connection, which overcomes the hereinafore-mentioned disadvantages of the heretofore-known devices of this general type in such a way that it allows a feed pump to be constructed in as compact a manner as possible in the vertical direction.

With the foregoing and other objects in view there is provided, in accordance with the invention, a connection for a feed line leading to an internal combustion engine of a motor vehicle. The connection is disposed at a feed pump pumping fuel out of a fuel tank, and the connection comprises a connection stub having a horizontal portion projecting away from the feed pump for connection of the feed line, and a nonreturn valve disposed in the horizontal portion of the connection stub.

As a result of this configuration, on one hand, the length of the feed pump can be made particularly small since it requires only a very small vertical portion, if any, for connection to the connection stub. The placement of the nonreturn valve in the horizontal portion, on the other hand, does not lead to an increase in the dimensions since this piece of the feed line projects sideways in any case. As a result, the feed pump that has the connection according to the invention has small dimensions in the vertical direction and therefore has a particularly compact construction.

In accordance with another feature of the invention, the connection is particularly economical if the connection stub is connected integrally to an adjoining part of the feed pump.

In accordance with a further feature of the invention, the mounting of the nonreturn valve is particularly simple if at least that part of the connection stub which has the nonreturn valve is secured releasably on the remaining region of the connection stub or on the feed pump. Another advantage of this configuration is that a standardized test adapter for all feed pumps can be used before securing the connection stub. The connection stub can be configured in almost any desired manner in accordance with the connection provided to the feed line.

In accordance with an added feature of the invention, the operation of the feed pump together with that of the nonreturn valve can be checked through the use of a standardized test adapter if a region of the connection stub that has the coupling device for the feed line is secured releasably on the remaining region of the connection stub or on the feed pump.

In accordance with an additional feature of the invention, the mounting of the connection stub on the feed pump is particularly simple if a device for fastening the connection stub to the adjoining part of the feed pump has a latching device.

In accordance with yet another feature of the invention, the nonreturn valve has, for example, a ball as a valve body. In accordance with yet a further feature of the invention, the radial dimensions of the nonreturn valve and flow losses through the valve body can be kept particularly small if a valve body of the nonreturn valve has a projecting guide element.

In accordance with a concomitant feature of the invention, the structure of the nonreturn valve is particularly simple if it has a cage with a guide for the guide element.

Other features which are considered as characteristic for the invention are set forth in the appended claims.

Although the invention is illustrated and described herein as embodied in a connection, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE DRAWINGS

FIG. 1 is a fragmentary, diagrammatic, partly sectional view of a feed pump with a connection according to the invention;

FIG. 2 is an enlarged, fragmentary, sectional view of the connection which is taken along a line II—II of FIG. 1, in the direction of the arrows; and FIG. 3 is a fragmentary, sectional view of the connection which is taken along a line III—III of FIG. 2, in the direction of the arrows.

DESCRIPTION OF THE PREFERRED EMBODIMENTS

Referring now to the figures of the drawings in detail and first, particularly, to FIG. 1 thereof, there is seen a feed pump which is provided for use in a fuel tank 24 of a motor vehicle and has a housing 1 and a housing cover 2. The housing cover 2 has a connection 3 with a feed line 4 connected thereto. The feed line 4 leads, for example, to a non-illustrated flange, which closes a mounting opening of the fuel tank 24. The feed pump draws-in fuel through an intake stub 5 disposed on an opposite side from the housing cover 2 and the feed pump pumps the fuel to the connection 3. The connection 3 has a connection stub 6, which is secured in a form-locking manner on the housing cover 2 through the use of a latching device 7.

FIG. 2 is an enlarged sectional view through the connection 3 of the feed pump, which is taken along a line II—II in FIG. 1, and shows that the connection stub 6 has a spigot, neck or tap 8 which enters a socket 11 in the housing cover 2. The spigot, neck or tap 8 is sealed off in the socket 11 through the use of an O-ring 10 disposed in a groove 9. The latching device 7 has two latching arms 13*a*, 13*b* that enter oppositely disposed latching recesses 12*a*, 12*b*.

FIG. 3 is a sectional view through the connection 3, which is taken along a line III—III in FIG. 2, and shows that the connection stub 6 is angled and has a horizontal portion 14 and a vertical portion 15. The feed line 4 in FIG. 1 has not been shown in FIG. 3 to simplify the drawing. A nonreturn valve 16 is disposed in the horizontal portion 14. The nonreturn valve 16 has a valve body 19 which is preloaded against a valve seat 17 through the use of a spring 18, and the nonreturn valve 16 has a cage 20 to support the spring 18. The cage 20 is welded to the connection stub 6 and has a central tubular guide 21 to accommodate a guide element 22 of the valve body 19. In a basic condition, the spring 18 presses the valve body 19 against the valve seat 17. This prevents fuel from flowing back into the fuel tank from an internal combustion engine 25 of the motor vehicle through the feed line 4 illustrated in FIG. 1. When fuel is being pumped by the feed pump, the valve body 19 is pushed away from the valve seat 17 against the force of the spring 18. Fuel then flows around the valve body 19 and through the cage 20. A coupling device 23 for the feed line 4 illustrated in FIG. 1 is disposed on the horizontal portion 14 of the connection stub 6.

I claim:

1. A connection for a feed line leading to an internal combustion engine of a motor vehicle, the connection disposed at a feed pump pumping fuel out of a fuel tank, and the connection comprising:

a connection stub having a horizontal portion projecting away from the feed pump for connection of the feed line; and a nonreturn valve disposed in said horizontal portion of said connection stub; and a device for fastening said connection stub to a part of the feed pump adjoining said connection stub, said device having a latching device.

2. The connection according to claim 1, wherein said connection stub is integrally connected to an adjoining part of the feed pump.

3. The connection according to claim 1, wherein said connection stub has a remaining region, and at least said horizontal portion of said connection stub having said nonreturn valve is releasably secured at the remaining region.

4. The connection according to claim 1, wherein at least said horizontal portion of said connection stub having said nonreturn valve is releasably secured at the feed pump.

5. The connection according to claim 1, wherein said connection stub has a region for receiving the feed line and a remaining region, and a coupling device for said region for receiving the feed line is releasably secured at the remaining region.

6. The connection according to claim 1, wherein said connection stub has a region for receiving the feed line, and a coupling device for said region for receiving the feed line is releasably secured at the feed pump.

7. The connection according to claim 1, wherein said nonreturn valve has a valve body with a projecting guide element.

8. The connection according to claim 7, wherein said nonreturn valve has a cage with a guide for said guide element.

* * * * *